US009136581B2

(12) United States Patent
Sato

(10) Patent No.: US 9,136,581 B2
(45) Date of Patent: Sep. 15, 2015

(54) WIRELESS TERMINAL APPARATUS

(71) Applicant: Koichi Sato, Tachikawa (JP)

(72) Inventor: Koichi Sato, Tachikawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 188 days.

(21) Appl. No.: 13/719,684

(22) Filed: Dec. 19, 2012

(65) Prior Publication Data

US 2013/0271329 A1 Oct. 17, 2013

(30) Foreign Application Priority Data

Apr. 13, 2012 (JP) ..... 2012-091770

(51) Int. Cl.
*H01Q 1/24* (2006.01)
*H01Q 1/00* (2006.01)
*H01Q 9/42* (2006.01)

(52) U.S. Cl.
CPC ..... *H01Q 1/00* (2013.01); *H01Q 1/245* (2013.01); *H01Q 9/42* (2013.01)

(58) Field of Classification Search
CPC ..... H01Q 1/242; H01Q 1/243; H01Q 9/42
USPC ..... 343/702, 720
See application file for complete search history.

(56) References Cited

U.S. PATENT DOCUMENTS

| | | | | |
|---|---|---|---|---|
| 6,894,647 | B2 | 5/2005 | Jenwatanavet | |
| 7,026,999 | B2 | 4/2006 | Umehara et al. | |
| 7,403,160 | B2 | 7/2008 | Chiang et al. | |
| 7,636,065 | B2 | 12/2009 | Ohishi et al. | |
| 7,847,741 | B2 | 12/2010 | Hirota | |
| 7,965,242 | B2 | 6/2011 | Abramov et al. | |
| 8,432,322 | B2 * | 4/2013 | Amm et al. | 343/702 |
| 8,681,057 | B2 * | 3/2014 | Jung et al. | 343/702 |
| 8,772,917 | B2 * | 7/2014 | Takano et al. | 257/679 |
| 2003/0193437 | A1 | 10/2003 | Kangasvieri et al. | |
| 2004/0108957 | A1 | 6/2004 | Umehara et al. | |
| 2007/0167920 | A1 | 7/2007 | Hommann | |
| 2007/0229366 | A1 | 10/2007 | Kim et al. | |
| 2007/0252827 | A1 | 11/2007 | Hirota | |
| 2008/0258992 | A1 | 10/2008 | Tsai et al. | |
| 2009/0305742 | A1 | 12/2009 | Caballero et al. | |
| 2010/0156745 | A1 | 6/2010 | Andrenko et al. | |
| 2010/0194658 | A1 | 8/2010 | Yukimoto et al. | |
| 2010/0214181 | A1 | 8/2010 | Ryou et al. | |
| 2010/0245265 | A1 | 9/2010 | Sato et al. | |

(Continued)

FOREIGN PATENT DOCUMENTS

| | | |
|---|---|---|
| JP | 2007-295393 | 11/2007 |
| JP | 2010-239211 | 10/2010 |
| JP | 2011-188435 | 9/2011 |
| JP | 2011-205265 | 10/2011 |
| JP | 2012-033135 | 2/2012 |
| WO | 2009-128333 A1 | 10/2009 |

OTHER PUBLICATIONS

Japanese Patent Application No. 2012-91770, Explanation of Situation for Accelerated Examination, mailed Mar. 8, 2013, (with English Translation).

(Continued)

*Primary Examiner* — Hoang V Nguyen
(74) *Attorney, Agent, or Firm* — William W. Schaal; Rutan & Tucker, LLP

(57) ABSTRACT

According to one embodiment, a wireless terminal apparatus includes an antenna unit and a sensor unit in a housing. The sensor unit is disposed so that at least part of the sensor unit overlaps the antenna unit.

19 Claims, 4 Drawing Sheets

(56) References Cited

U.S. PATENT DOCUMENTS

| | | | |
|---|---|---|---|
| 2013/0038560 | A1 | 2/2013 | Sato et al. |
| 2013/0169593 | A1 | 7/2013 | Imamura et al. |

OTHER PUBLICATIONS

Japanese Patent Application No. 2012-091770, First Office Action, mailed May 14, 2013, (with English Translation).

* cited by examiner

WIRELESS TERMINAL APPARATUS

CROSS-REFERENCE TO RELATED APPLICATIONS

This application is based upon and claims the benefit of priority from Japanese Patent Application No. 2012-091770, filed Apr. 13, 2012, the entire contents of which are incorporated herein by reference.

FIELD

Embodiments described herein relate generally to a wireless terminal apparatus comprising an antenna.

BACKGROUND

In recent years, notebook computers in which a display unit is rotatably attached to a main body via a hinge, and tablet information terminals adopting a tablet as a display unit have been widely used. The terminal apparatus of this type includes a radio module and an antenna. By using its wireless communication function, the terminal apparatus can download contents and various data from, for example, a web site, and perform message and television telephone communications or the like with another terminal via a wireless network. The wireless network includes, for example, a cellular phone communication network, such as a 3G cellular phone communication network, wireless local area network (Wireless LAN), WiMAX (registered trademark), ultra-wideband (UWB), and Bluetooth (registered trademark).

When a user uses the wireless terminal apparatus of this type, an antenna may come close to the user's body (such as a stomach, a chest, or an arm). In USA, FCC (Federal Communications Commission) sets the upper limit of the specific absorption rate (SAR), which is a physical quantity representing the degree of energy of radio waves absorbed by a human body, and makes it mandatory to control the SAR not to exceed the limit.

Therefore, for example, the technique of providing a wireless terminal apparatus with a sensor for detecting approach of a user, and lowering a transmit power when the sensor detects approach of a user, and the technique of providing a plurality of antennas to different sides of a housing and, when a terminal is oriented such that an antenna comes close to a user, switching the antenna used for transmission to another antenna have been proposed. If those techniques are used, influence due to radio waves emitted by an antenna on a user can be efficiently reduced.

Recently, the wireless terminal apparatus of this type has often been provided with a plurality of antennas so that the wireless terminal apparatus can access multiple types of radio networks, and comply with Long Term Evolution (LTE) and spatial diversity. Further, improving portability by further reducing the size of the terminal is under discussion. Under such requirements, it has become increasingly difficult to arrange a plurality of antennas and sensors flush with one another in the housing of the wireless terminal apparatus having a limited space.

BRIEF DESCRIPTION OF THE DRAWINGS

A general architecture that implements the various features of the embodiments will now be described with reference to the drawings. The drawings and the associated descriptions are provided to illustrate the embodiments and not to limit the scope of the invention.

DETAILED DESCRIPTION

Various embodiments will be described hereinafter with reference to the accompanying drawings.

In general, according to one embodiment, a wireless terminal apparatus comprises, in its housing, an antenna unit and a sensor unit. The sensor unit is provided so that at least part of the sensor unit overlaps the antenna unit.

One Embodiment

Figure 1:
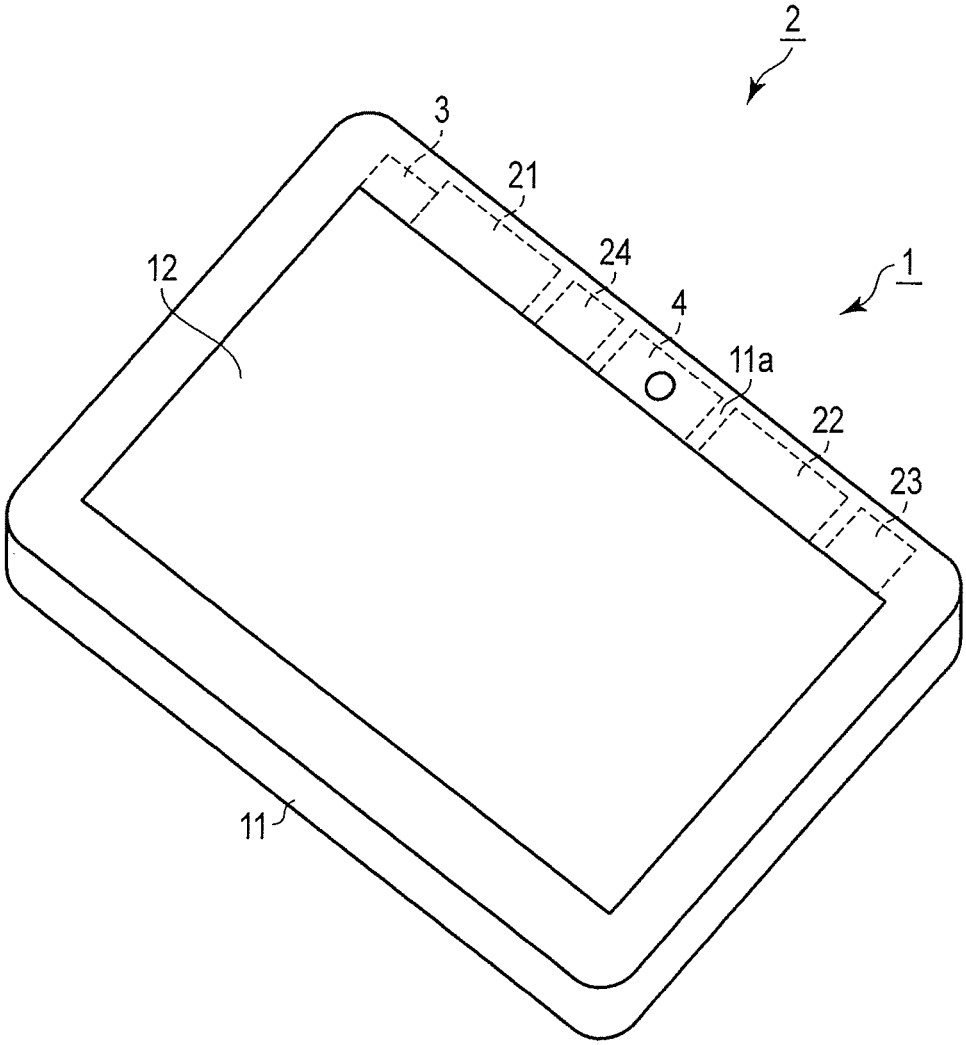
FIG. 1 is a perspective view showing an appearance of a wireless terminal apparatus according to one embodiment.
Figure 2B:
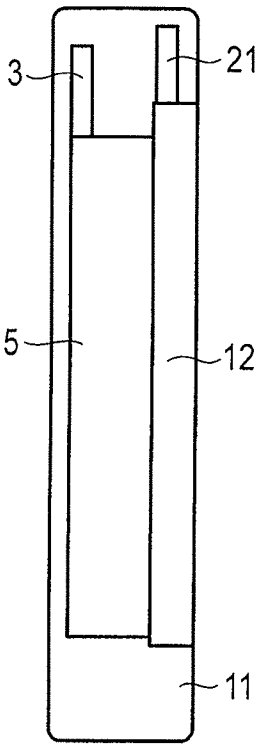
FIGS. 2A and 2B are a plan view and a side view showing an internal configuration of the wireless terminal apparatus according to one embodiment.
Figure 2A:
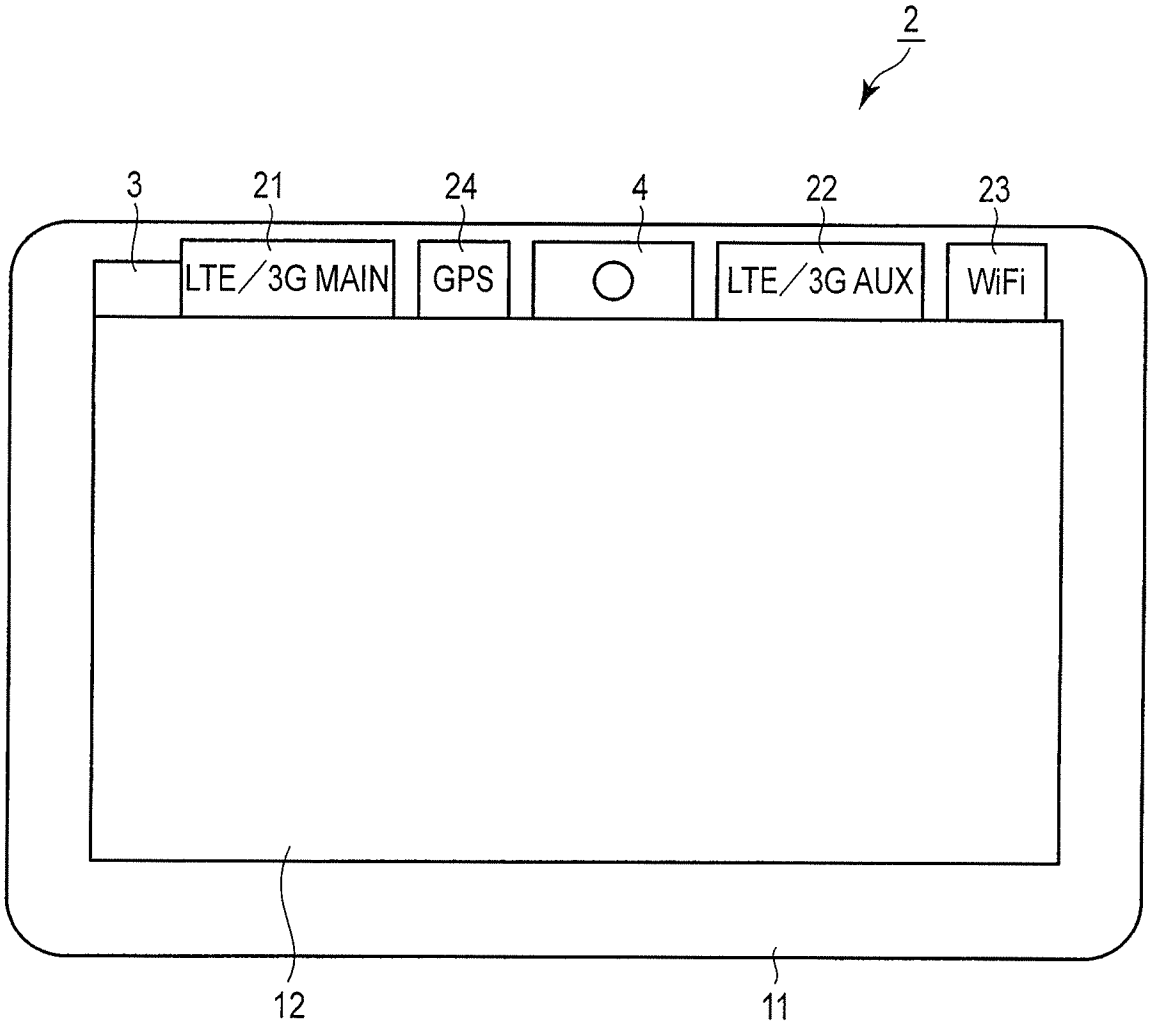

FIG. 1 is a perspective view showing an appearance of a wireless terminal apparatus 1 according to one embodiment. FIGS. 2A and 2B are a plan view and a side view showing an internal configuration of the wireless terminal apparatus 1.

The wireless terminal apparatus 1 of this embodiment comprises a touch panel information terminal. In the wireless terminal apparatus 1, a display 12 comprising a touch panel is disposed on a top surface of a housing 11. As the touch panel, for example, a capacitive touch panel is used. As the display, for example, a liquid crystal display or an organic electroluminescent (EL) display is used.

In the middle of one of the four sides of the housing 11 supporting the display 12, a web camera 4 is disposed. A group of antennas 2 are disposed on both sides of the web camera 4. As shown in FIG. 2, the antenna group 2 comprises an LTE/3G first antenna unit 21, an LTE/3G second antenna unit 22, which constitutes an LTE antenna cooperatively with the first antenna unit 21, a wireless local area network (Wireless LAN) antenna unit (WiFi [registered trademark] antenna unit) 23, and a global positioning system (GPS) antenna unit 24. The antenna units 21-24 are each formed on an independent or common circuit board, and disposed, together with the circuit board, in the housing 11 near the surface of the housing 11. The place where the antenna units are formed is not limited to the circuit board. The antenna units may be formed, for example, on the housing.

Behind the first antenna unit 21 in the housing 11, a proximity sensor 3 is disposed to partly overlap the first antenna unit 21 with a predetermined space therebetween. The space between the first antenna unit 21 and the proximity sensor 3 is provided to reduce the influence due to the first antenna unit 21 on the proximity sensor 3, and is defined by interposing a mold, a spacer or a circuit board between the first antenna unit 21 and the proximity sensor 3.

Figure 3:
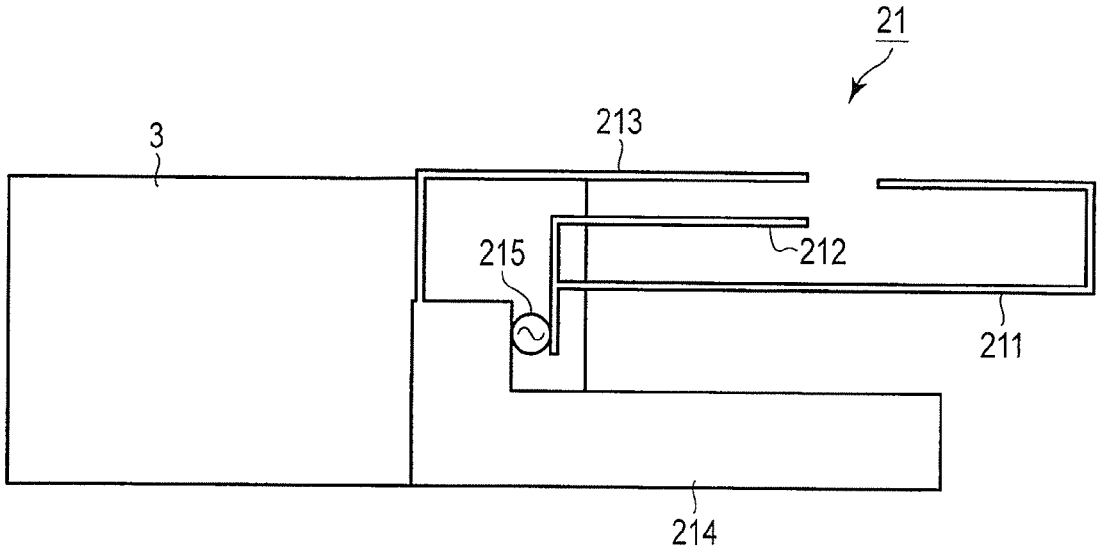
FIG. 3 is an enlarged plan view of a main part of the wireless terminal apparatus shown in FIGS. 1, 2A and 2B.

The proximity sensor 3 is disposed to overlap the first antenna unit 21 while avoiding an open end portion of the first antenna unit 21. FIG. 3 shows an exemplary arrangement.

As shown in FIG. 3, in the first antenna unit 21, first and second monopole elements 211, 212 are disposed parallel to one another, and a parasitic element 213 is disposed exterior and parallel to the second monopole element 212. The space between the parasitic element 213 and the second monopole element 212 is set to enable capacitive coupling between the parasitic element 213 and the second monopole element 212.

The first and second monopole elements 211, 212 have a rear end connected to a feed terminal 215, and have an open front end. The parasitic element 213 has a rear end connected to a ground pattern 214, and an open front end. The open end of the first monopole element 211 is folded back.

The proximity sensor 3 is disposed so that part of the proximity sensor 3 avoids an open end portion of the first monopole element 211 and overlaps only a rear end portion (portion closer to the feed terminal 215) of the first monopole element 211. This is because the voltage of the first monopole element 211 is higher at its open end, and interference caused by the voltage to the proximity sensor 3 should be minimized.

Next, the specific configuration of the proximity sensor 3 and the arrangement of the proximity sensor 3 relative to the first antenna unit 21 will be described by providing some examples.

(1) First Example

Figure 4:
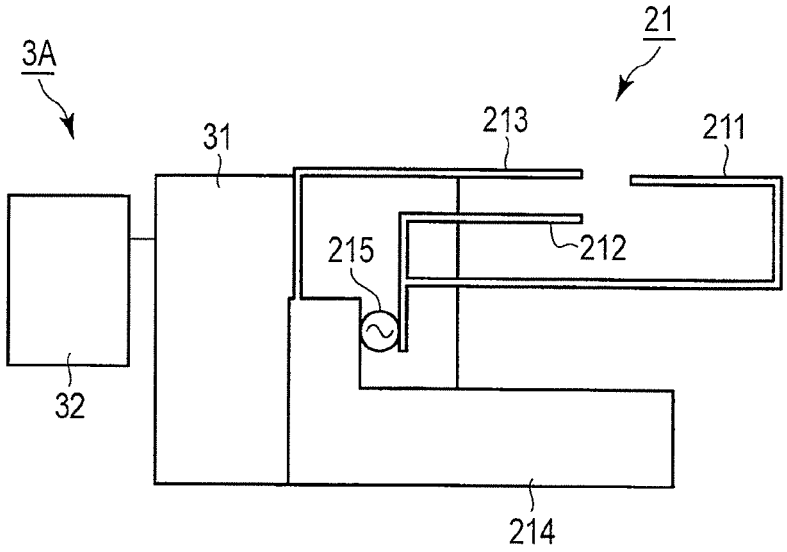
FIG. 4 shows a first example of the wireless terminal apparatus according to one embodiment.

In the first example, a capacitive proximity sensor 3A is used. For example, as shown in FIG. 4, the proximity sensor 3A comprises a sensor plate (sensing electrode) 31 and a sensor circuit 32 connected to the sensor plate 31. The sensor plate 31 detects a change in the capacitance caused when a user approaches, and outputs a detection signal. The sensor circuit 32 converts the detection signal output from the sensor plate 31 into a digital signal, determines whether a user is in the proximity of the wireless terminal apparatus 1 by comparing the digital signal with a predetermined threshold, and outputs a proximity detection signal representing the determination result.

The proximity sensor 3A is positioned so that part of the sensor plate 31 does not overlap an open end portion of the first antenna unit 21 and overlaps only a portion closer to the feed terminal 215. The sensor circuit 32 is positioned not to overlap the portion of the first antenna unit 21 closer to the feed terminal 215.

Since the proximity sensor 3A has such a configuration, when the wireless terminal apparatus 1 goes close to a user, the capacitance of the sensor plate 31 changes, and when the detection signal level exceeds a threshold, a proximity detection signal is output from the sensor circuit 32. Even if the first antenna unit 21 is under transmission at that moment, interference between the proximity sensor 3A and the first antenna unit 21 can be suppressed, because the sensor plate 31 and the sensor circuit 32 are positioned not to overlap open end portions of the elements 211-213.

Accordingly, even when the capacitive proximity sensor 3A is used, accurate proximity detection can be made without receiving a large influence due to an antenna. Further, since the proximity sensor 3A is contained in the housing 11 in such a manner that part of the proximity sensor 3A overlaps the first antenna unit 21, the proximity sensor 3A can be disposed even in such a small space in the housing 11 that the proximity sensor 3A cannot be disposed flush with the antenna group 2.

When the proximity detection signal is output, a control unit (not shown) controls, for example, transmit powers of the first and second antenna units 21, 22 to reduce the SAR.

(2) Second Example

Figure 5:
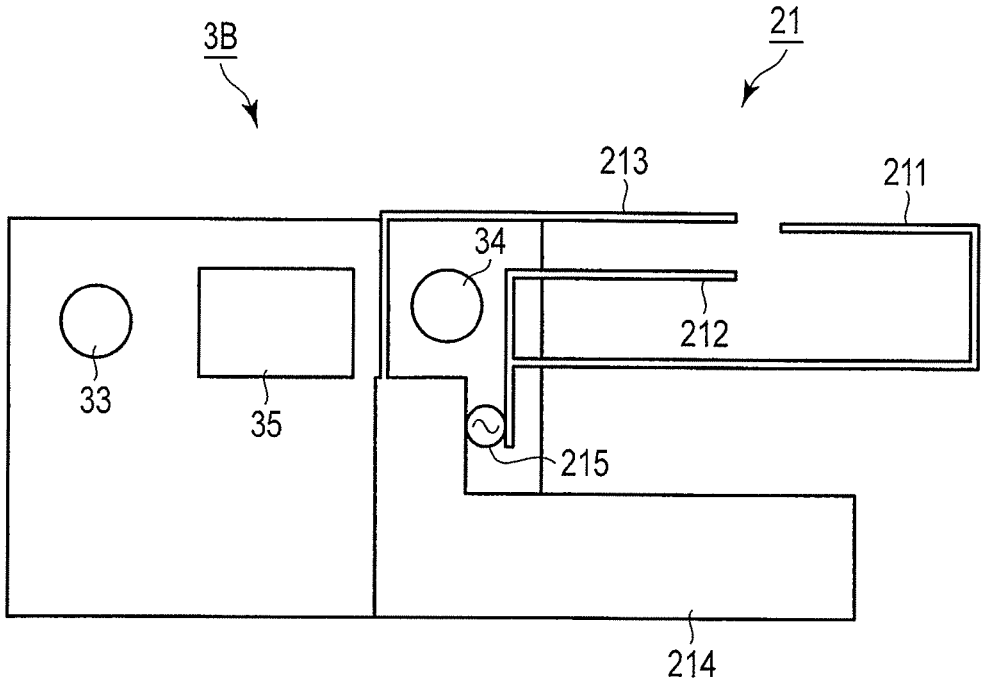
FIG. 5 shows a second example of the wireless terminal apparatus according to one embodiment.

In the second example, an infrared proximity sensor 3B is used. For example, as shown in FIG. 5, the infrared proximity sensor 3B comprises a light-emitting element 33 and a light receiving element 34 on a circuit board, and a sensor circuit 35 between the light-emitting element 33 and the light receiving element 34. The light-emitting element 33 emits infrared light to the periphery of the terminal. The light receiving element 34 receives infrared light emitted from the light-emitting element 33 and reflected by a user, and inputs a light receiving signal to the sensor circuit 35. The sensor circuit 35 converts the input light receiving signal into a digital signal, determines whether a user is in the proximity by, for example, comparing the digital signal with a predetermined threshold, and outputs a proximity detection signal representing the determination result.

The proximity sensor 3B is positioned so that the light-emitting element 33 or light receiving element 34 (light receiving element 34 in FIG. 5) does not overlap an open end portion of the first antenna unit 21 and overlaps only a portion closer to the feed terminal 215. Further, the sensor circuit 35 is positioned not to overlap the portion of the first antenna unit 21 closer to the feed terminal 215.

Since the proximity sensor 3B has such a configuration, when the wireless terminal apparatus 1 goes close to a user, the signal level of the light receiving signal output from the light receiving element 34 changes, and when the light receiving signal level exceeds a threshold, a proximity detection signal is output from the sensor circuit 35. Even if the first antenna unit 21 is under transmission at that moment, the proximity sensor 3B is not directly influenced by interference due to the first antenna unit 21, because the sensor circuit 35 is positioned not to overlap not only open end portions of elements 211-213 but also portions closer to the feed terminal 215.

Accordingly, even when the infrared proximity sensor 3B is used, accurate proximity detection can be made without receiving a large influence due to coupling (interference) with an antenna. Further, since the proximity sensor 3B is contained in the housing 11 in such a manner that part of the proximity sensor 3B overlaps the first antenna unit 21, the proximity sensor 3B can be disposed even in such a small space in the housing 11 that the proximity sensor 3B cannot be disposed flush with the antenna group 2. The operation for reducing the SAR after output of the proximity detection signal is the same as the one of the first example.

(3) Third Example

The third example is a modification of the second example. In the third example, a ground plate is disposed between the infrared proximity sensor 3B and the first antenna unit 21.

Figure 6:
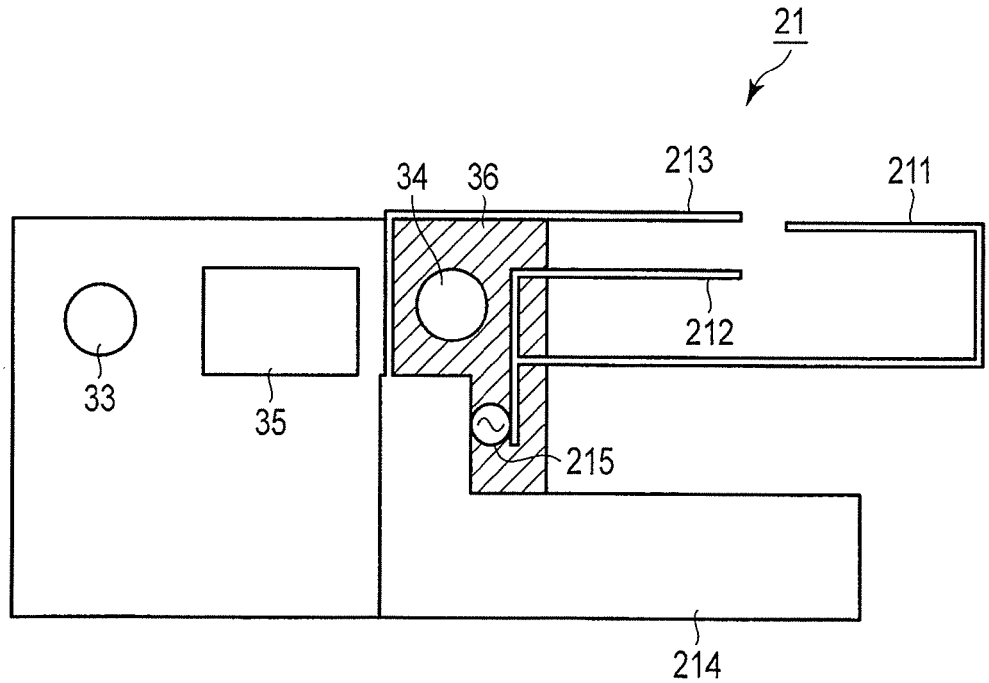
FIG. 6 shows a third example of the wireless terminal apparatus according to one embodiment.

FIG. 6 shows the arrangement. In FIG. 6, a ground plate 36 is interposed between the infrared proximity sensor 3B and the antenna unit 21 where the infrared proximity sensor 3B overlaps the first antenna unit 21. The ground plate 36 is a circuit board having a surface on which a ground pattern is formed. The ground pattern is electrically connected to a ground pattern for the terminal apparatus contained in the housing 11 of the terminal apparatus or the ground pattern 214 for the antenna group 2 so that the ground patterns have the same electric potential.

Since the infrared proximity sensor 3B has such a configuration, influence due to an antenna current flowing in the portion of the first antenna unit 21 closer to the feed terminal 215 is blocked by the ground plate 36, and can be further prevented from stretching to the proximity sensor 3B. Accordingly, even when the infrared proximity sensor 3B is used, accurate proximity detection can be made without receiving a large influence due to the antenna current. Further, since the proximity sensor 3B is contained in the housing 11 in such a manner that part of the proximity sensor 3B overlaps the first antenna unit 21, the proximity sensor 3B can be disposed even in such a small space in the housing 11 that the proximity sensor 3B cannot be disposed flush with the antenna group 2.

Other Embodiments

In the above embodiment, the case where a tablet information terminal has been described as an example. However, the embodiment is applicable to a mobile terminal, such as a smartphone, or a laptop computer. Further, described in one embodiment is the case where part of the proximity sensor 3 overlaps the LTE/3G antenna unit 21. However, part of the proximity sensor 3 may overlap the WiFi antenna unit 23.

In addition, the configuration of the antenna unit, and the type and configuration of the sensor may be modified for implementation.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A wireless terminal apparatus comprising:

a housing;

a touch panel supported by the housing;

an antenna unit positioned within the housing, the antenna unit comprises an antenna element that comprises a first end coupled to a feed terminal and a second end which is open; and a sensor unit positioned within the housing, the sensor unit comprises a sensor electrode configured to detect a change in capacitance, and a sensor circuit configured to detect an object approaching the wireless terminal apparatus based on a potential change of the sensor electrode, at least part of the sensor electrode overlaps a part of the antenna element other than the second end of the antenna element.

2. The wireless terminal apparatus of claim 1, wherein:

the housing comprises a first surface facing in a same direction as the touch panel and a second surface of the housing that is opposite to the first surface of the housing;

the sensor electrode of the sensor unit and the antenna element of the antenna unit are positioned between the first surface of the housing and the second surface of the housing; and in a direction perpendicular to at least one of the first surface of the housing and the second surface of the housing, the at least part of the sensor electrode overlaps the part of the antenna element other than the second end of the antenna element.

3. The wireless terminal apparatus of claim 2, wherein a distance between the antenna unit and the first surface of the housing is shorter than a distance between the antenna unit and the second surface of the housing; and a distance between the sensor unit and the first surface of the housing is longer than a distance between the sensor unit and the second surface of the housing.

4. The wireless terminal apparatus of claim 1, further comprising:

a controller configured to lower a transmission power from the antenna unit when the sensor unit detects the approach of the object to the wireless terminal apparatus.

5. The wireless terminal apparatus of claim 1, wherein:

the housing comprises a first surface facing in a same direction as the touch panel and a second surface of the housing that is opposite to the first surface of the housing;

the sensor electrode of the sensor unit and the antenna element of the antenna unit are positioned between the first surface of the housing and the second surface of the housing; and in a direction perpendicular to at least one of the first surface of the housing and the second surface of the housing, the at least part of the sensor electrode overlaps the part of the antenna element that includes the first end of the antenna element and excludes the second end of the antenna element.

6. A wireless terminal apparatus comprising:

a housing;

an antenna unit positioned within the housing, the antenna unit comprises an antenna element that comprises a first end connected to a feed terminal and a second end which is open; and a sensor unit positioned within the housing, the sensor unit comprises a substrate, a light-emitting element on the substrate configured to emit infrared light, a light receiving element on the substrate configured to receive infrared light emitted by the light-emitting element and reflected by an object, and a sensor circuit configured to detect the object approaching the wireless terminal apparatus based on a light receiving signal output from the light receiving element, at least one of the light-emitting element and the light receiving element overlaps a part of the antenna element other than the second end of the antenna element.

7. The wireless terminal apparatus of claim 6, wherein the housing comprises a first surface facing in a same direction as the touch panel and a second surface of the housing that is opposite to the first surface of the housing;

the sensor unit and the antenna element of the antenna unit are positioned between the first surface of the housing and the second surface of the housing; and in a direction perpendicular to at least one of the first surface of the housing and the second surface of the housing, the at least one of the light-emitting element and the light receiving element overlaps the part of the antenna element other than the second end of the antenna element.

8. The wireless terminal apparatus of claim 7, wherein a distance between the antenna unit and the first surface of the housing is shorter than a distance between the antenna unit and the second surface of the housing, and a distance between the sensor unit and the first surface of the housing is longer than a distance between the sensor unit and the second surface of the housing.

9. The wireless terminal apparatus of claim 6, further comprising:

a controller configured to lower a transmission power from the antenna unit when the sensor unit detects the approach of the object to the wireless terminal apparatus.

10. A wireless terminal apparatus comprising:
a housing;
a touch panel supported by the housing;
an antenna unit positioned within the housing; and
a sensor unit positioned within the housing, at least a part of the sensor unit overlaps the antenna unit; and
a ground plate between the sensor unit and the antenna unit.

11. The wireless terminal apparatus of claim 10, wherein
the housing comprises a first surface facing in a same direction as the touch panel and a second surface of the housing that is opposite to the first surface of the housing;
the sensor unit and the antenna element of the antenna unit are positioned between the first surface of the housing and the second surface of the housing; and
in a direction perpendicular to at least one of the first surface of the housing and the second surface of the housing, the part of the sensor unit overlaps the antenna element.

12. The wireless terminal apparatus of claim 10, wherein
the housing comprises a first surface facing in a same direction as the touch panel and a second surface of the housing that is opposite to the first surface of the housing;
a distance between the antenna unit and the first surface of the housing is shorter than a distance between the antenna unit and the second surface of the housing, and
a distance between the sensor unit and the first surface of the housing is longer than a distance between the sensor unit and the second surface of the housing.

13. The wireless terminal apparatus of claim 10, further comprising:
a controller configured to lower a transmission power from the antenna unit when the sensor unit detects an approach of an object to the wireless terminal apparatus.

14. A wireless terminal apparatus comprising:
a display on a surface of a housing;
a light emitting element in the housing;
a light receiving element in the housing; and
an antenna element in the housing, the antenna element comprising a first part, the first part connected to a ground pattern, wherein
the housing comprises a first side along a width direction, a second side along a length direction, and a third side along a thickness direction, and
the first part is between the light emitting element and the light receiving element in the length direction of the housing.

15. The wireless terminal apparatus of claim 14, wherein
the first part is between the first side of the housing and the light receiving element and a first direction through the light receiving element and the first part crosses the first side of the housing.

16. The wireless terminal apparatus of claim 15, wherein
the antenna element comprising a second part, the second part is between the light receiving element and the second side of the housing,
a second direction through the light receiving element and the second part crosses the second side of the housing, and
the first side crosses the second side at right angles.

17. The wireless terminal apparatus of claim 16, further comprising a second antenna element, and wherein
the housing comprises the third side parallel to the first side, and
the second antenna element is between the light receiving element and the third side of the housing along the first direction.

18. A wireless terminal apparatus comprising:
a display on a surface of a housing;
a light emitting element in the housing;
a light receiving element in the housing; and
an antenna element in the housing, the antenna element comprising a first part and a second part, the first part connected to a feed terminal, wherein
the first part is between a first side of the housing and the light receiving element, and a first direction through the light receiving element and the first part crosses the first side of the housing,
the second part is between the light receiving element and a second side of the housing, and a second direction through the light receiving element and the second part crosses the second side of the housing.

19. The wireless terminal apparatus of claim 18, further comprising a second antenna element, and wherein
the housing comprises a third side connected to the second side and parallel to the first side, and
the second antenna element is between the light receiving element and the third side of the housing along the first direction.

* * * * *